US007053553B1

(12) United States Patent
Fülöp et al.

(10) Patent No.: US 7,053,553 B1
(45) Date of Patent: May 30, 2006

(54) STARTING AID FOR FLUORESCENT LAMP

(75) Inventors: József Fülöp, Nápoly (HU); Róbert Kardos, Flotilla (HU); Ferenc Papp, Ugró Gyula (HU)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/416,238

(22) PCT Filed: May 11, 2000

(86) PCT No.: PCT/US00/12978

§ 371 (c)(1),
(2), (4) Date: May 7, 2003

(87) PCT Pub. No.: WO01/87019

PCT Pub. Date: Nov. 15, 2001

(51) Int. Cl.
*H01J 17/44* (2006.01)

(52) U.S. Cl. ..... 313/594; 313/593; 313/595; 313/607; 439/611; 439/612

(58) Field of Classification Search ..... 313/607, 313/234, 318.01, 593–595, 634, 318.1; 315/56–58; 439/611, 612, 617, 618
See application file for complete search history.

(56) References Cited

U.S. PATENT DOCUMENTS 4,523,126 A * 6/1985 Hammer et al. ..... 313/594
4,701,667 A 10/1987 Cinalli ..... 313/594
(Continued)

*Primary Examiner*—Ashok Patel
*Assistant Examiner*—Anthony Canning
(74) *Attorney, Agent, or Firm*—Fay, Sharpe, Fagan, Minnich & McKee, LLP

(57) ABSTRACT

A starting aid in combination with a fluorescent lamp is provided. The lamp comprises a glass discharge tube (2) which includes a discharge path and is convoluted to have a plurality of discharge tube legs. These legs extend into and are secured in place in a plastic housing. Lamp electrodes (40, 42) are located at respective end points of a discharge path and disposed in some of the discharge tube legs. The lamp electrodes are connected to means suitable for electrically connecting to a socket. The starting aid comprises an electrical connector disposed in the plastic housing of the florescent lamp. The starting aid has a first end and a second end. The first end is connected to the means suitable for electrically connecting to the socket. The second end is secured to an end portion of an electrodeless discharge tube leg. At least a part of the electrical connector is formed as a spring. A fluorescent lamp system with a starting aid is also provided. The lamp system comprises a ballast unit which controls electrical power received from an external power source. The electrodes (40, 42) of a sealed lamp unit are connected electrically to the ballast unit and disposed in adjacent tube legs of the sealed lamp unit. A first electrical connector (36) is connected with one end to the first lamp electrode (40). Its other end is secured at least to one of the tube legs located along the discharge path consecutively next to the tube leg in which the second electrode (42) is disposed. A second electrical connector (38) with one end is connected to the second lamp electrode (42). Its other end is secured at least to one of the tube legs located along the discharge path consecutively next to the tube leg in which the first electrode is disposed.

23 Claims, 5 Drawing Sheets

U.S. PATENT DOCUMENTS 4,853,591 A 8/1989 Klein et al. ..... 313/493
5,053,933 A 10/1991 Imris ..... 362/221
5,081,395 A 1/1992 Kikuchi et al. ..... 313/594
5,086,249 A * 2/1992 Blaisdell et al. ..... 313/318.1
5,751,105 A * 5/1998 Cserteg et al. ..... 313/493
6,011,347 A * 1/2000 Wittmann ..... 313/318.09

* cited by examiner

Fig. 8
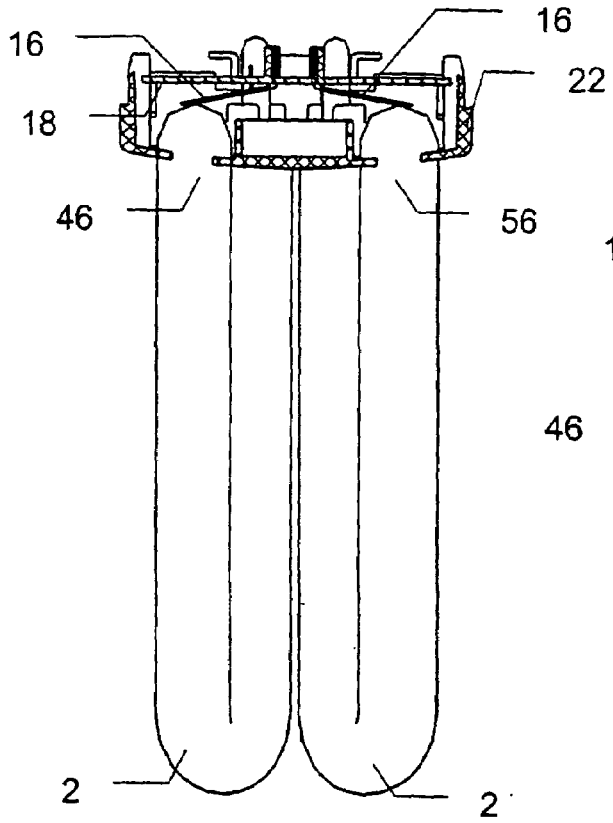
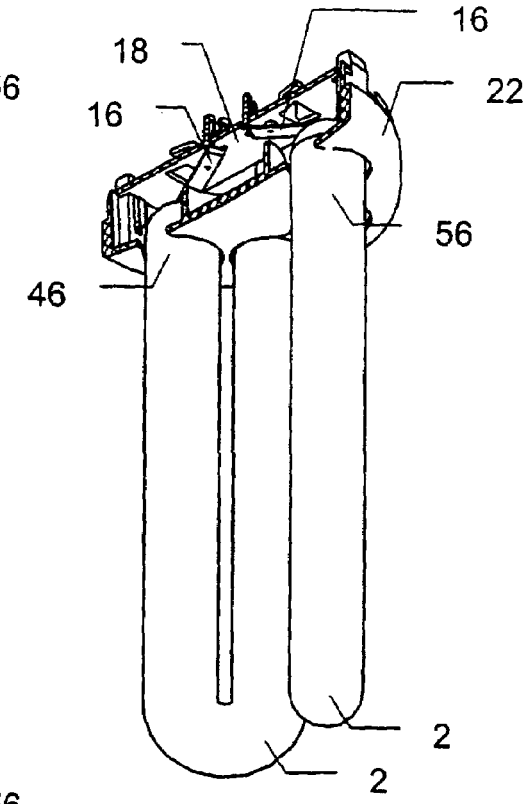
Fig. 10
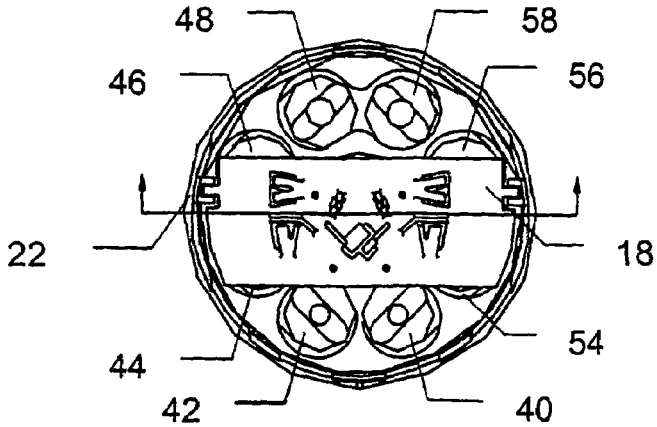
Fig. 9

STARTING AID FOR FLUORESCENT LAMP

FIELD OF THE INVENTION

This invention relates to a starting aid for fluorescent lamps and, and more particularly, to a structure and electrical connection of the starting aid suitable for reducing the starting voltage of the lamp.

BACKGROUND OF THE INVENTION

Fluorescent lamps, especially compact fluorescent lamps of higher wattage, e.g. 26 W or above this wattage, require high starting voltage. This problem arises primarily at amalgam dosed lamps operated at room temperature, but also occurs in the event of pure mercury dosed lamps operated at lower ambient temperature. The high starting voltage causes compatibility issues even in the field of an increasing number of ballasts and applications. The problem is also related to the fact that an increasing number of luminaries have plastic reflectors rather than metallic ones and the plastic reflector cannot serve as a starting aid. It is difficult to meet the starting voltage requirements specified by the standards without sacrificing lumen output, lumen maintenance and lifetime in the wattage range mentioned.

U.S. Pat. No. 4,523,126 describes a starting aid for shaped discharge lamps. The starting aid is a metal band secured to the discharge tube. The starting voltage reduction sharply depends on the location of the starting bands. This feature implies an accurate positioning of the starting bands relative to cathode location. Experiments were conducted in order to prove the effectiveness of the solution described in the above-cited patent when applied at compact fluorescent lamps, but no significant starting voltage reduction could be accomplished. It is believed that the negative result is due to the different lamp geometry and the different filling gas. A further disadvantage of the starting aid according to the cited patent is a loss in light output due to the shielding action of the starting band. Calculating with the preferred width of starting bands, the lumen loss expected is in the range of 2–4 percent. A further drawback is that a conductive part is placed on a touchable portion of the lamp. When the hot cathode hits the wall of the glass tube at the end of the life of the lamp the wall may crack and a current path may be formed to the metallic starting band. The user of the lamp may be exposed to electrical shock.

A similar design is described in U.S. Pat. No. 4,701,667 in which a ring shape starting aid is applied to fluorescent lamps. This starting aid may cause dangerous electric shock and decreases the light output.

Thus there is a particular need to provide a starting aid which reduces the starting voltage of the fluorescent lamp significantly without decreasing the light output of the lamp and ensures safety against electric shock at the end of the life of the lamp.

BRIEF DESCRIPTION OF THE INVENTION

As an exemplary embodiment of one aspect of this invention, a starting aid in combination with a fluorescent lamp is provided. The lamp comprises a glass discharge tube which includes a discharge path and is convoluted to have a plurality of discharge tube legs. These legs extend into and are secured in place in a plastic housing. Lamp electrodes are located at respective end points of a discharge path and disposed in some of the discharge tube legs. The lamp electrodes are connected to means suitable for electrically connecting to a socket. The starting aid comprises an electrical connector disposed in the plastic housing of the fluorescent lamp. The starting aid has a first end and a second end. The first end is connected to the means suitable for electrically connecting to the socket. The second end is secured to an end portion of an electrodeless discharge tube leg. At least a part of the electrical connector is formed as a spring.

In an exemplary embodiment of another aspect of the present invention, a fluorescent lamp system with a starting aid is provided. The lamp system comprises a ballast unit which controls electrical power received from an external power source. A sealed lamp unit contains a gas and includes a plurality of discharge tube legs and a continuous discharge path. First and second lamp electrodes are located at respective end points of the discharge path. The electrodes are connected electrically to the ballast unit and disposed in adjacent tube legs of the sealed lamp unit. A first electrical connector is connected with one end to the first lamp electrode. Its other end is secured at least to one of the tube legs located along the discharge path consecutively next to the tube leg in which the second electrode is disposed. A second electrical connector is connected with one end to the second lamp electrode. Its other end is secured at least to one of the tube legs located along the discharge path consecutively next to the tube leg in which the first electrode is disposed.

This structure and electrical connection of the starting aid has a number advantages over the prior art. One advantage is that the starting voltage of the lamp is reduced significantly due to the structure and electrical cross connection of the two electrical connectors of the starting aid. Another advantage is that dangerous electrical shocks are avoided since the starting aid is located in the plastic housing of the lamp and there is no additional metal component part on the surface of the lamp that can be touched by the user. A further advantage is that the lumen output of the lamp is not decreased by the starting aid since the structure according to the present invention is not applied to a light-emitting surface of the lamp.

BRIEF DESCRIPTION OF THE DRAWINGS

FIG. 8 is an axial-section view of the shell portion with a discharge tube of a compact fluorescent lamp and a plastic support plate mounted with leaf springs;

FIG. 9 is a top view of the compact fluorescent lamp according to FIG. 8;

FIG. 10 is a perspective view in partial axial-section of the lamp according to FIG. 8;

DETAILED DESCRIPTION OF THE INVENTION

Figure 1:
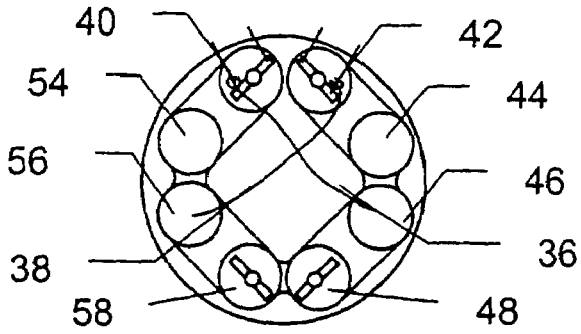
FIG. 1 shows an electrical connection of a starting aid with two electrical connectors schematically.
Figure 2:
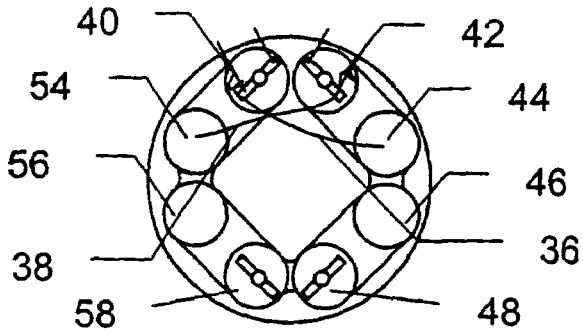
FIG. 2 shows another possible connection of the starting aid.
Figure 3:
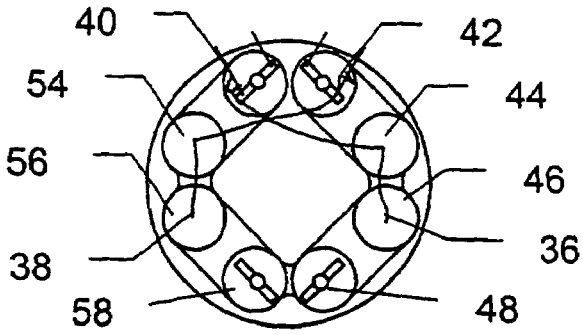
FIG. 3 shows a further possible connection of the starting aid.

FIGS. 1–3 illustrate the electrical connection of the starting aid. Each of the figures is a bottom view of a compact fluorescent lamp, showing the layout of the discharge tube. The discharge tube includes of U-shape sections having tube legs, which are connected to each other by bridges establishing a continuous discharge path. The discharge path starts from the tube end with a first electrode 40, goes through electrodeless tube legs 54, 56, 58, 48, 46, 44 and terminates at a tube leg with a second electrode 42. The ends of some electrodeless tube legs 44, 46, 54, 56 are metallized, the metallized tube ends are indicated by hatching in the figures. First and second electrical connectors 36, 38 are cross-connected, i.e. the first electrode 40 is coupled with at least one of the ends of the electrodeless discharge tube legs located along the discharge path consecutively next to the tube leg in which the second electrode 42 is disposed. The second electrode 42 is in turn coupled with at least one of the ends of the electrodeless discharge tube legs located along the discharge path consecutively next to the tube leg in which the first electrode 40 is disposed. Due to this cross-connection, a capacitive current comes into being and makes the lamp start at a reduced voltage applied to the electrodes.

Referring now to FIG. 1, the first and second electrodes 40, 42 are located at respective end points of the discharge path. The first electrical connector 36 is connected with one end to the first lamp electrode 40 and its other end is secured to the second tube leg 46 located along the discharge path next to the tube leg in which the second electrode 42 is disposed. The second electrical connector 38 is connected with one end to the second lamp electrode 42 and its other end is secured to the second tube legs 56 located along the discharge path next to the tube leg in which the first lamp electrode 40 is disposed.

As FIG. 2 shows, while one end of the electrical connectors 36, 38 is connected to the electrodes similarly to the connection in FIG. 1, the other end of the first electrical connector 36 is secured to the first electrodeless tube leg 44 located next to the tube leg in which the second electrode 42 is disposed. The other end of the second electrical connector 38 is secured to the first electrodeless tube leg 54 next to the tube leg in which the first electrode 40 is disposed.

As FIG. 3 illustrates, while one end of the electrical connectors 36, 38 is connected to the electrodes 40, 42 similarly to the connection of FIGS. 1 and 2, the other end of the first electrical connector 36 is secured to two consecutive electrodeless tube legs 44, 46 located next to the tube leg in which the second electrode 42 is disposed. The other end of the second electrical connector 38 is secured to two consecutive electrodeless tube legs 54, 56 located next to the tube leg in which the first electrode 40 is disposed.

Figure 4:
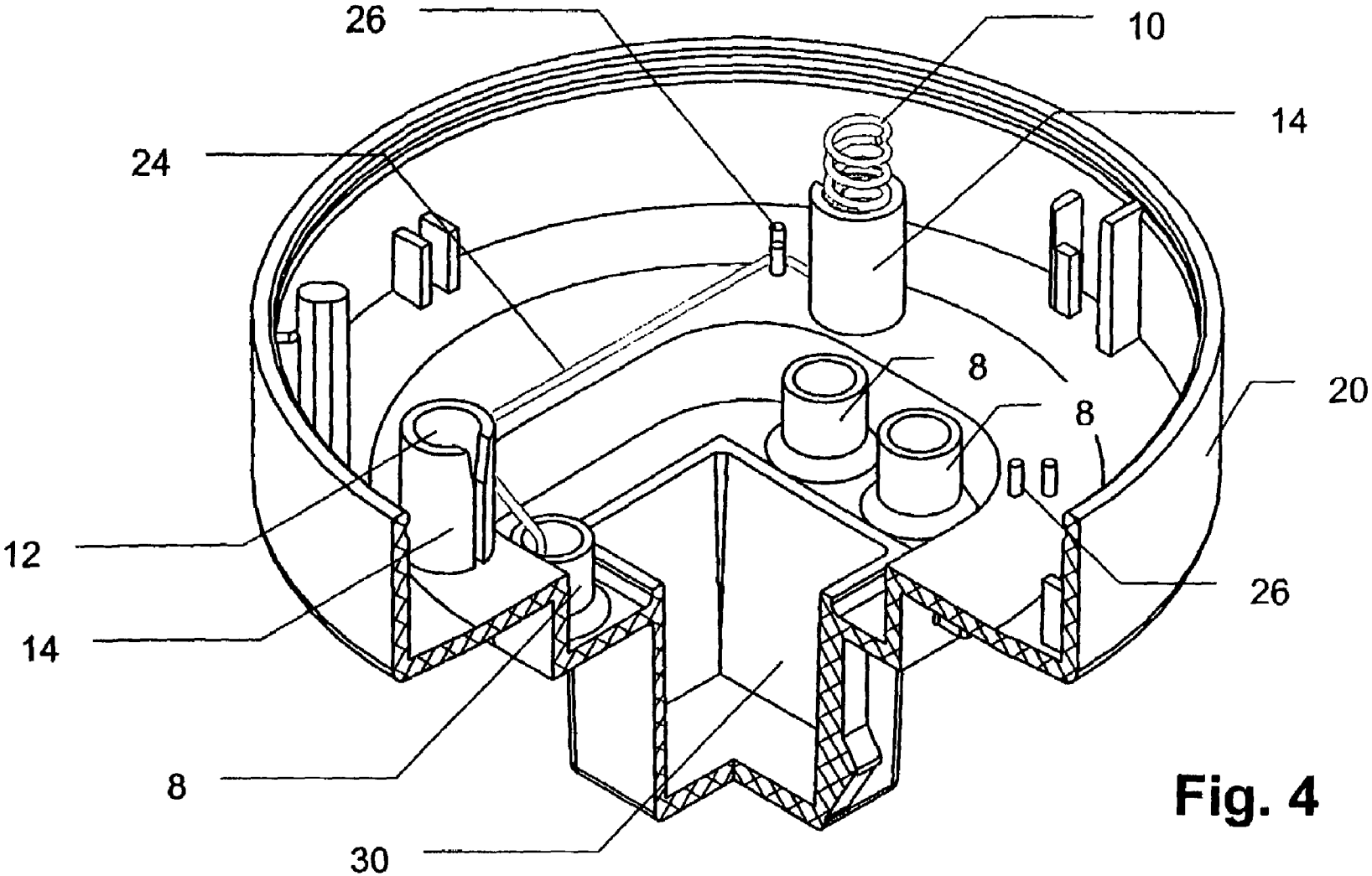
FIG. 4 is a perspective view in partial axial-section of a shell portion of a lamp housing with starting aid.

FIGS. 4–13 illustrate structural embodiments of the starting aid. Referring now to FIG. 4, it shows a shell portion 20 which is one part of the to plastic housing of a compact fluorescent lamp. The other part of the housing is a cap portion which will be described in the forthcoming figures. Additionally, a socket (not shown) belongs to the lamp system generally including a ballast unit in the event of compact fluorescent lamps of plug-in type. The mechanical attach to the socket is established by a support plug 30 protruding from the bottom of the shell portion 20, while four contact pins 8 are provided for electrical connection towards the ballast unit. In the figure, an electrical connector of the starting aid is represented by a contact wire 24 made of chrome-steel material. Its first end is attached to a contact pin 8, and its second end is formed as a helical spring 10 embedded in a nest 12 of a protrusion 14 extending from the bottom wall of the shell portion 20. A middle part of the contact wire 24 is led through plastic guides 26 from the contact pin 8 up to the protrusion 14. Only one contact wire 24 is shown in the figure, however a second one can also be disposed within the shell portion 20. During the assembly of the lamp, the first end of the contact wire 24 together with a lead-in wire of an electrode will be crimped in a contact pin 8 connecting the electrical connector of the starting aid to the electrode of the lamp. The free end of the helical spring 10 will resiliently lean against one of the metallized electrodeless tube ends thereby pressing the second end of the contact wire 24 to an end portion of the electrodeless discharge tube. An effective capacitive coupling comes into being between the electrical connector of the starting aid and the discharge path point at the electrodeless tube end. Due to the effective capacitive coupling, an additional electrical potential is formed along the discharge path between the electrodes which modifies the breakdown path of the electrical field and reduces the starting voltage.

Figure 5:
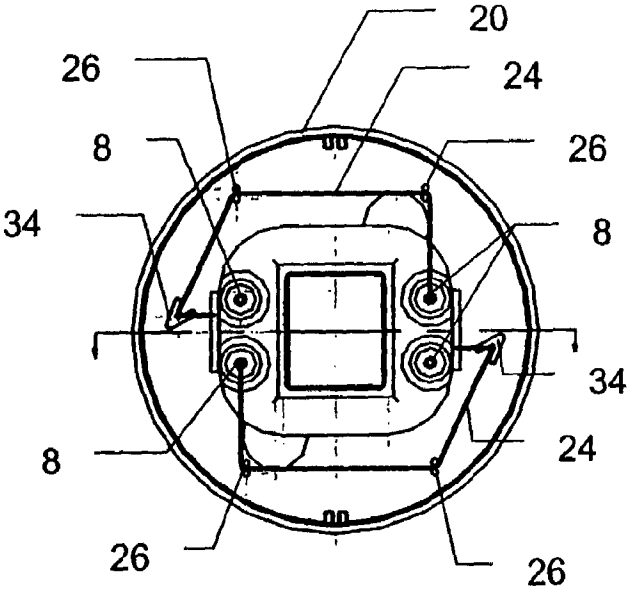
FIG. 5 is a top view of the shell portion including the elements of a starting aid with bent wire spring.
Figure 7:
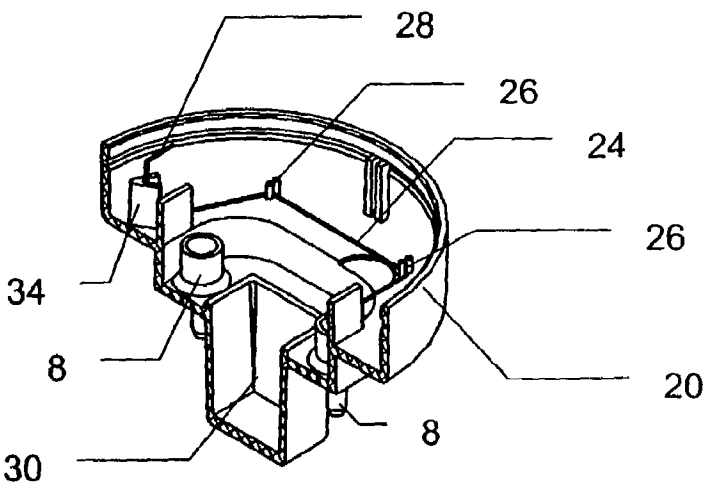
FIG. 7 is a perspective view partly in axial-section of the shell portion according to FIG. 5.
Figure 6:
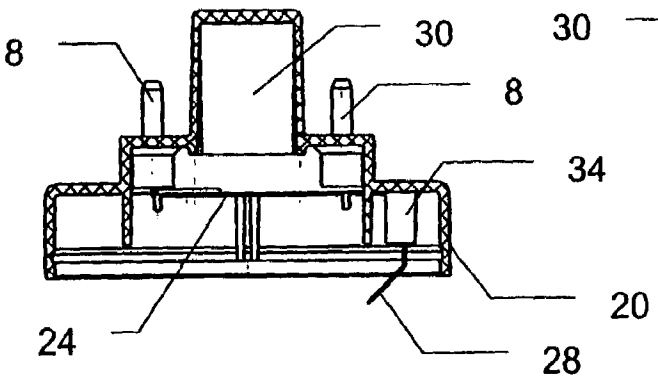
FIG. 6 is a side view in axial-section of the shell portion according to FIG. 5.

In FIGS. 5–7, another embodiment of the starting aid is shown. The first end of the electrical connector is connected to the contact pin 8 and the second end is simply bent to form a wire spring 28. The middle portion is a contact wire 24 and is led through plastic guides 26 similarly to the previous embodiment. The wire spring 28 is nested in a plastic deflector 34 protruding from the bottom of the shell portion 20. During the lamp-making process, when the cap portion 22 is fixed to the shell portion 20, the free end of the wire spring 28 will resiliently lean against one of the metallized electrodeless tube ends, while the first end of the contact wire 24 together with a lead-in wire of an electrode will be crimped in a contact pin 8 similarly to the embodiment according to FIG. 4. The metallization of the tube ends can be made by a dabber print process or by sprinkling a paint containing a metal in a few microns of thickness. In FIG. 5, two contact wires 24 with wire springs 28 are shown secured in place in the shell portion 20.

Another embodiment of the starting aid is shown in FIGS. 8–10. The discharge tube 2 is fixed in the cap portion 22 by the ends of the tube legs. The first and second electrode 40, 42 are inserted into two adjacent tube legs, the others are electrodeless tube legs 44, 46, 48, 54, 56, 58. The end portions of two electrodeless tube legs 46, 56 are metallized. A plastic support plate 18 including two leaf sprigs 16 is attached to the cap portion 22. The free ends of the leaf springs 16 lean resiliently against the ends of the metallized electrodeless discharge tube legs 46, 56 establishing an electrical connection with them. The other end thereof is pressed into the plastic support plate 18 and welded to a conductive wire which is connected to the electrodes and the contact pin of the shell portion illustrated in FIG. 4 during the lamp assembly process.

Figures 11, 12, 13:
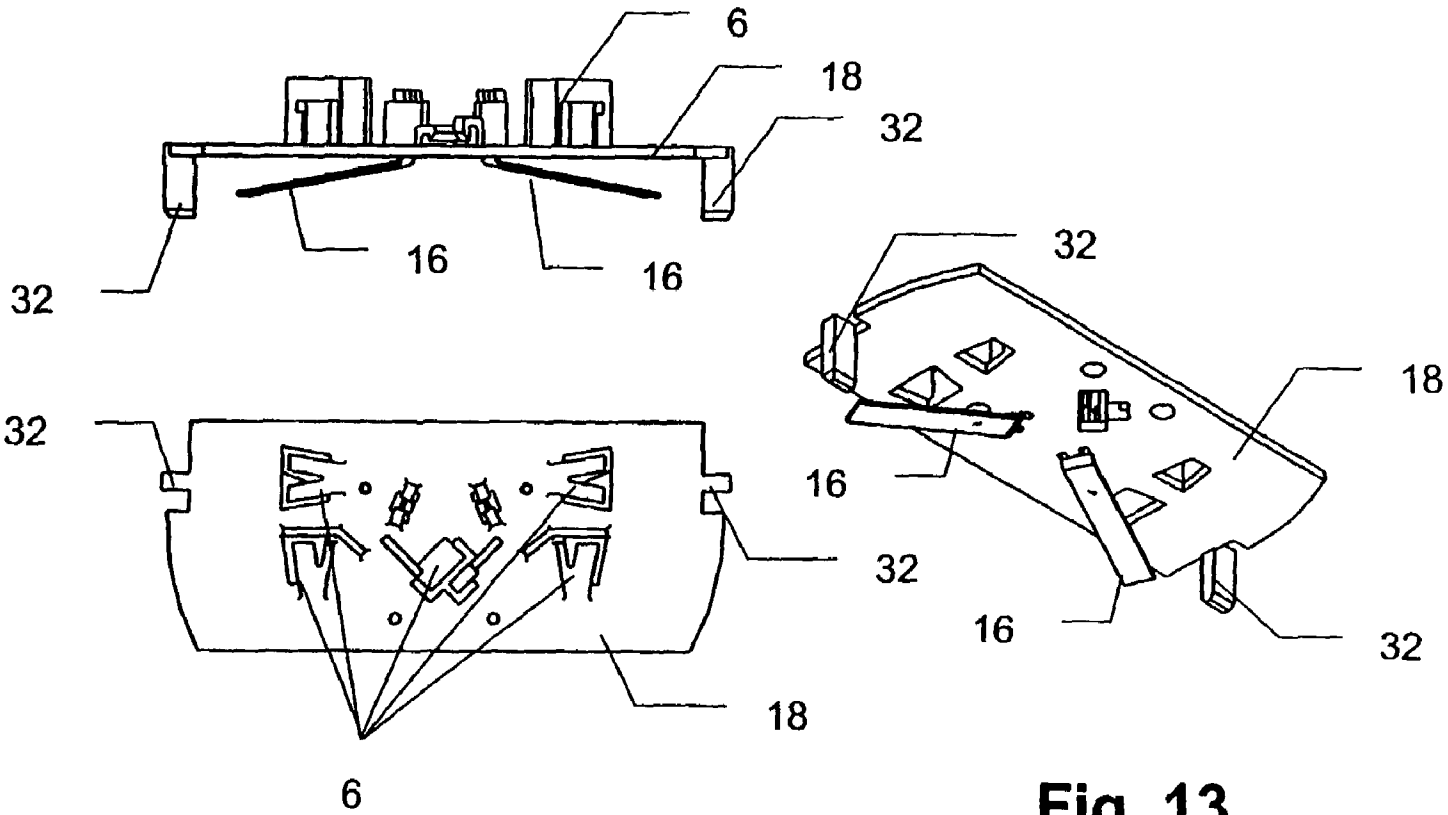
FIG. 11 is a side view of the plastic support plate including the elements of a starting aid with the leaf spring.
FIG. 12 is a top view of the plastic support plate according to FIG. 11.
FIG. 13 is a perspective view of the plastic support plate with the leaf springs.

FIGS. 11–13 show a detailed structure of the plastic support plate 18 with the leaf spring 16. The plastic support plate 18 is secured in the cap portion of the lamp by ribs 32 protruding substantially parallel to a longitudinal axis of the lamp at an edge portion of the plastic support plate. The leaf springs 16 are inserted into the plastic support plate 18 by snapping one of their ends into the plastic support plate 18. The leaf springs 16 are made of resilient steel and serve as the second ends of the electrical connectors, the first ends of which correspond to the first ends of the conductive wires mentioned above. Insulators 6 protrude from the side of the plastic support plate 18 opposite to the tube ends in order to promote the insulation of the conducting elements mounted in the housing of the lamp.

In further embodiments, the spring portion of the electrical connector can be made of conductive sponge or rubber.

Experiments were conducted in order to prove the effectiveness of the starting aid according to the embodiments of the invention. The starting aids were built in the plastic housing of compact fluorescent lamps of types 42 W HEX and 42 W OCT. The starting voltages at different ambient temperatures were investigated. The results of the test are shown in Table 1.

TABLE 1

| | Starting voltage [Vms] | | | | |
|---|---|---|---|---|---|
| | 42W HEX | | | 42W OCT | |
| Temp | without aid | with aid, no metallization | with aid, metallization | without aid | with aid |
| 25°C. | 523 | 515 | 359 | 633 | 530 |
| 10°C. | 536 | n/a | 396 | 647 | 524 |
| −15°C. | 584 | n/a | 454 | 660 | 575 |

Another test was made for different types of starting aids, the result of which is shown in Table 2.

TABLE 2

| Type of starting aid | It is seen in | Starting voltage [Vms] |
|---|---|---|
| Starting aid connected to the tube end second from the electrodes, cross connection | FIG. 1 | 555 |
| Starting aid connected to the tube end first from the electrodes, cross connection | FIG. 2 | 513 |
| Starting aid connected to the tube ends first and second from the electrodes, cross connection | FIG. 3 | 533 |

As it is seen in the table, the most significant reduction can be accomplished by the starting aid described with reference to FIG. 2.

The starting aid structure and the electrical cross-connection of its two electrical conductors reduces the starting voltage of the fluorescent lamp significantly without decreasing the light output of the lamp and ensure safety against electric shock at the end of the life of the lamp. The two electrical conductors of the starting aid provide additional two discharge path points between the electrodes of the lamp. The voltage potential applied to the lamp electrodes is also applied to these additional discharge path points thereby modifying the breakdown path of the electrical field significantly. The springy structure of the electrical conductors of the starting aid ensures a firm capacitive coupling towards the discharge path thereby increasing the effectiveness of the additional discharge path points. An even more effective coupling is accomplished by the metallized end portion of the tube legs to which the electrical conductors are secured. Since the starting aid of the present invention is disposed in the plastic housing, it cannot cause dangerous electric shock and does not decrease the lumen output of the lamp.

One skilled in the art may propose or make modification to the structure and/or function and/or manner of the disclosed embodiments without departing from the scope and extent of the invention.

The invention claimed is:

1. A fluorescent lamp comprising:

a glass discharge tube having a discharge path and a plurality of discharge tube legs extending into and secured in place in a housing;

lamp electrodes located at respective end points of a discharge path and disposed in some of the discharge tube legs, the lamp electrodes being connected to means for electrically connecting to a socket;

a starting aid comprising:

an electrical connector disposed in the housing and having a first end and a second end;

the first end being connected to the means for electrically connecting to the socket, and the second end being secured to an end portion of an electrodeless discharge tube leg; and at least a part of the second end of the electrical connector being formed as a spring.

2. The lamp of claim 1 in which the end portion of the electrodeless discharge tube leg to which the second end of the electrical connector is secured is metallized.

3. The lamp of claim 1 in which the means for electrically connecting to a socket is a contact pin.

4. The lamp of claim 1 in which the electrical connector is a wire coiled to form a helical spring at the second end thereof for pressing the second end to the end portion of the electrodeless discharge tube leg.

5. The lamp of claim 4 in which the helical spring is located in a nest formed in a protrusion of the housing.

6. The lamp of claim 3 in which the first end of the electrical connector is crimped to the contact pin.

7. The lamp of claim 1 in which the electrical connector is a wire connected to a leaf spring forming the second end of the electrical connector for pressing the second end to the end portion of the electrodeless discharge tube leg.

8. The lamp of claim 7 in which one end of the leaf spring is fixed to a support plate being disposed in the housing.

9. The lamp of claim 1 in which the housing comprises a shell portion and a cap portion fixed to each other, and the discharge tube legs are secured to the cap portion and the means for electrically connecting to a socket is fixed in the shell portion.

10. A fluorescent lamp system having a starting aid, the fluorescent lamp system comprising: a ballast unit controlling electrical power received from an external power source; a sealed lamp unit containing a gas and having a plurality of discharge tube legs and a continuous discharge path; first and second lamp electrodes located at respective end points of the discharge path, the electrodes being connected electrically to the ballast unit and disposed in adjacent tube legs of the sealed lamp unit; a first electrical connector having an end connected to the first lamp electrode and another end secured at least to one of the electrodeless tube legs located along the discharge path consecutively next to the tube leg in which the second electrode is disposed; and a second electrical connector having an end connected to the second lamp electrode and another end secured at least to one of the electrodeless tube legs located along the discharge path consecutively next to the tube leg in which the first electrode is disposed; and the other end of the first electrical connector is secured at least to one of the electrodeless tube legs located along approximately one-half of the discharge path consecutively next to the tube leg in which the second electrode is disposed; and the other end of the second electrical connector is secured at least to one of the electrodeless tube legs located along approximately one-half of the discharge path consecutively next to the tube leg in which the first electrode is disposed.

11. The system of claim 10 in which the other end of the first electrical connector is secured to the first electrodeless tube leg located along approximately one-half of the discharge path next to the tube leg in which the second electrode is disposed; and the other end of the second electrical connector is secured to the first electrodeless tube leg located along approximately one-half of the discharge path next to the tube leg in which the first electrode is disposed.

12. The lamp of claim 1 wherein the housing is made of plastic.

13. The lamp of claim 8 wherein the support plate is made of plastic.

14. A starting aid for a fluorescent lamp comprising:

an electrical connector having a first end and a second end, the connector being disposed in a plastic housing of the lamp;

the first end connected to a means for electrically connecting the lamp;

the second end being connected to an end portion of an electrodeless discharge tube leg of the lamp; and at least part of the connector is formed as a resilient member.

15. The starting aid of claim 1 wherein the end portion is metallized.

16. The starting aid of claim 1 wherein the means for electrically connecting is a contact pin.

17. The starting aid of claim 1 wherein the electrical connector is a spring fixed at the second end.

18. The starting aid of claim 1 wherein the resilient member is a helical spring.

19. The starting aid of claim 18 wherein the helical spring is located in a protrusion of the housing.

20. The starting aid of claim 16 wherein the first end of the connector is crimped to the contact pin.

21. The starting aid of claim 13 wherein the electrical connector is a wire connected to a leaf spring forming the second end of the connector.

22. The starting aid of claim 20 wherein one end of the leaf spring is fixed to a plastic support plate disposed in the housing.

23. The starting aid of claim 13 wherein the housing comprises:

a shell portion;

a cap portion fixed to the shell portion;

the discharge tube leg is secured to the cap portion; and the means for electrically connecting is fixed in the shelf portion.

* * * * *

UNITED STATES PATENT AND TRADEMARK OFFICE

CERTIFICATE OF CORRECTION

PATENT NO. : 7,053,553 B1
APPLICATION NO. : 10/416238
DATED : May 30, 2006
INVENTOR(S) : Jozsef Fulop et al.

It is certified that error appears in the above-identified patent and that said Letters Patent is hereby corrected as shown below:

Title Page:

Item [75], Inventors, please add "Istvan Wursching, Erzsebet (HU)"

Signed and Sealed this

Seventeenth Day of March, 2009

JOHN DOLL
*Acting Director of the United States Patent and Trademark Office*